United States Patent [19]

Tamura et al.

[11] Patent Number: 4,824,026

[45] Date of Patent: Apr. 25, 1989

[54] AIR ATOMIZING ELECTROSTATIC COATING GUN

[75] Inventors: Kenji Tamura, Nagoya; Hirofumi Hashimoto; Youichiro Baba, both of Toyota; Sadao Inose, Yokohama, all of Japan

[73] Assignee: Toyota Jidosha Kabushiki Kaisha and Ransburg-Gema K.K., Tokyo, Japan

[21] Appl. No.: 80,637

[22] Filed: Jul. 31, 1987

[30] Foreign Application Priority Data

| | | | |
|---|---|---|---|
| Aug. 6, 1986 | [JP] | Japan | 61-120727[U] |
| Aug. 6, 1986 | [JP] | Japan | 61-120728[U] |
| Aug. 6, 1986 | [JP] | Japan | 61-120729[U] |
| Aug. 6, 1986 | [JP] | Japan | 61-120730 |
| Aug. 6, 1986 | [JP] | Japan | 61-120731[U] |

[51] Int. Cl.[4] ..... B05B 5/02

[52] U.S. Cl. ..... 239/707; 239/412; 239/417.3; 239/708

[58] Field of Search ..... 239/704, 705, 706, 707, 239/708, 691, 296, 297, 298, 300, 412, 417.3, 424.5

[56] References Cited

U.S. PATENT DOCUMENTS

| | | | |
|---|---|---|---|
| 2,059,706 | 11/1936 | Paasche | 239/412 |
| 3,169,882 | 2/1965 | Juvinall et al. . | |
| 3,463,121 | 8/1969 | Walberg . | |
| 3,583,632 | 6/1971 | Shaffer . | |
| 3,599,038 | 8/1971 | Skidmore . | |
| 3,667,682 | 6/1972 | Purnell | 239/412 |
| 3,731,145 | 5/1973 | Senay . | |
| 3,814,328 | 6/1974 | Warning | 239/296 |
| 3,873,023 | 3/1975 | Moss et al. | 239/705 |
| 3,938,739 | 2/1976 | Bertilsson | 239/705 |
| 4,508,276 | 4/1985 | Malcolm | 239/691 |
| 4,598,871 | 7/1986 | Hartle | 239/706 |

FOREIGN PATENT DOCUMENTS

| | | |
|---|---|---|
| 15477 | 8/1942 | Japan . |
| 18495 | 6/1974 | Japan . |
| 107940 | 8/1979 | Japan . |
| 99353 | 6/1982 | Japan . |
| 180256 | 10/1983 | Japan . |
| 62360 | 4/1984 | Japan . |
| 36282 | 10/1984 | Japan . |
| 176662 | 11/1984 | Japan . |
| 193168 | 11/1984 | Japan . |
| 5251 | 1/1985 | Japan . |
| 110360 | 6/1985 | Japan . |
| 100052 | 7/1985 | Japan . |
| 244358 | 12/1985 | Japan . |

*Primary Examiner*—Andres Kashnikow
*Assistant Examiner*—Michael J. Forman
*Attorney, Agent, or Firm*—Frishauf, Holtz, Goodman & Woodward

[57] ABSTRACT

An air atomizing electrostatic coating gun which atomizers a liquid paint by using air flows and thereafter applying atomized liquid paint to an object to be coated by using an electrostatic force. In this coating gun, all of a rod valve, a driving piston, an air cylinder and valve support members of a needle valve device are made of insulating materials having good insulating properties, and an electrode for charging paint particles is attached to the valve. A nozzle-needle valve assembly which is integrally constructed by attaching a paint nozzle to a cylindrical extension of the air cylinder which is formed at a front end portion thereof, is inserted and fitted into a generally cylindrical cavity in a front end portion of the gun body from the front side thereof. An integral molded body incorporating a direct current high-voltage power source is formed by molding a synthetic resin having good insulating properties to embed therein a boosting high-voltage transformer, a rectifier type direct current high-voltage generator and a spiral-wound flat high-resistance element, and this integral molded body is detachably attached and fixed inside of the gun body by inserting it into a cavity formed in a rear end portion of the gun body from the rear side thereof.

7 Claims, 3 Drawing Sheets

AIR ATOMIZING ELECTROSTATIC COATING GUN

BACKGROUND OF THE INVENTION

This invention relates to an electrostatic coating apparatus which is used in painting work for applying a liquid paint and, more particularly, to an air atomizing electrostatic coating gun which atomizes a liquid paint into very small particles by using air flows and which applies atomized particles by electrostatic force on an object to be coated.

An air atomizing electrostatic coating gun of conventional type comprises, a paint nozzle for ejecting a liquid paint there-through which is disposed at the front end of the body of the gun; a paint atomizing air cap having a central air orifice and a plurality of air orifices surrounding the central orifice which is also disposed at the front end of the gun body; a needle valve device for controlling ejection of the paint from the nozzle, which comprises an elongated rodlike valve having a front end portion generally in the shape of a cone which is brought into contact with or detached from a valve seat formed by a slanted inner wall of the paint nozzle, a valve driving piston fixed to the rear end of this valve, and an air cylinder accommodating this piston, and is incorporated in the gun body; and a thin elongated electrode for charging paint particles attached to said valve to project from its front end through the paint nozzle forward from the front end opening of the nozzle, and to which is applied a dc high voltage through a high-resistance element; and a change-over valve means for controlling supply of air to the air cylinder to operate the needle valve device such a conventional gun is constructed in such a manner that the rodlike valve of the needle valve device is formed into an integral body made of a metal and is adapted to function as a part of the conductor of the charging electrode, or it is formed into a tubular body made of a synthetic resin to have a center hole and the charging electrode is inserted into this center hole, or it is formed as a combined body consisting of a metal part which functions as a part of the electrode conductor and a synthetic resin part which functions as a valve member. Otherwise, the components of the needle valve device, i.e. the rodlike valve, the piston for driving the valve attached to the rear end of the valve, the air cylinder which accommodates the piston, and valve support members which are disposed in the cylinder to function as slide bearings and as retainers of the sealing for the valve are partly or entirely formed from metals.

In another example of the construction of the conventional air atomizing electrostatic coating gun of this type, the print nozzle which functions as a valve seat is fixed to the front end of the gun body, an air cylinder of the needle valve device is attached and fixed to the rear end of the gun body by inserting it into an axial hole formed in a rear portion of the gun body from the rear side thereof, and a rodlike valve having a generally cone-shaped front end portion extends forwardly through the paint chamber formed in a central portion of the gun body to engage its front end portion with a slanted inner wall of the paint nozzle.

The conventional air atomizing electrostatic coating gun also has a construction in which, in order to apply a dc high voltage through a current-limiting high-resistance element to the paint particle charging electrode in the form a straight wire passing through the paint nozzle and projecting forward from the front end opening of the nozzle, a comparatively large-sized rodlike resistor which has a high resistance is inserted into an axial hole formed through the gun body. Also the end portion of a high-tension cable which extends from a suitable direct current high-voltage generator disposed apart from the spray gun is introduced through a cable inlet hole into the gun body. The inner end of the cable conductor is connected to one end of the rodlike resistor, and the other end of the resistor is being connected to the charging electrode by a spring connector element.

However, if the valve in the needle valve device is partly or entirely formed of a metal, or if this part and/or other components of the needle valve device are formed of metal materials, it is, in fact, extremely difficult to completely insulate these metal components from the charging electrode. Thus, these metal components act as a part of the charging electrode, thereby increasing the capacitance thereof. There is therefore the risk of spark discharge occurring when the front end of the charging electrode is brought close to the human body, the object to be painted, a grounded metal member, etc., and, hence, the risk of injuring the human body or causing a fire by ignition of paint solvent. For complete insulation of the metal components, the size of the gun body is necessarily increased. If the whole body of the valve or the front end portion of the valve is formed of a synthetic resin, the sealing function of the front end member of the valve deteriorates so that the valve cannot effect accurate closing operation. Such deterieration is due to wearing of this member acting as a valve as the spray gun is used, due to its low hardness and wear resistance. The construction, in which the paint nozzle which acts as a valve seat is attached to the front end of the gun body and the needle valve device is disposed and fixed in a cavity formed in a rear portion of the gun body so that a generally cone-shaped front end portion of an elongated rodlike valve is engaged with the paint nozzle, is problematic in that it necessitates a laborious effort in dismantling the spray gun when the needle valve device needs to be checked or repaired. Also it is difficult for the valve to be brought into close contact with the valve seat due to an increased length of the valve. Also, there is a problem of the capacitance of the charging electrode being increased correspondently with an increase in the length of the charging electrode. In addition, the construction in which a direct current high-voltage generator disposed apart from the spray gun is connected to the spray gun by a high-tension cable to apply a dc high voltage to the charging electrode of the spray gun results in a spray gun which is difficult to handle smoothly and controllably. This is because an ordinary high-tension cable is heavy and has relatively low pliability of flexibility since it is generally formed with covering the conductor wires by several layers of insulating materials having good insulating properties, and fitting a helical metal tube around these insulating layers. In particular, there is a problem with of handling the gun smoothly when the spray gun is attached to an operating arm of a robot system so as to be automatically operated, and hence there is a possibility of the painting speed or the quality of the paint film being reduced.

SUMMARY OF THE INVENTION

It is, therefore an object of the present invention to provide an air atomizing electrostatic coating gun free from the above-described various defects and problems of the conventional air atomizing electrostatic coating guns having the above-described constructions, i.e. an air atomizing electrostatic coating gun which enables a small capacitance of the paint particle charging electrode so as to eliminate the risk of occurrence of spark discharge and ensure operational safety, enables a high durability of the valve of the needle valve device to prevent any considerable wear thereof, and to positively effect the operation of ejecting a liquid paint when the valve is opened and terminating the ejection of the paint when the valve is brought into close contact with the valve seat, enables the paint nozzle and the needle valve device to be easily attached to and detached from the gun body in a simple manner so that the needle valve device can be checked and repaired without requiring any complicated work and thus being easily maintained, make it possible to apply a dc high voltage to the charging electrode by supplying it with a low-voltage alternating current by means of a light and highly flexible low-voltage cable which does not prevent smooth handling of the spray gun, and is suitable for automatic operation by attaching it to the operation arm of a robot system.

To this end, the present invention provides an air atomization electrostatic spray gun which comprises:

(1) a needle valve device in which a rodlike valve is formed of a ceramic pipe having an axial center hole, a piston is formed of a ceramic material, and an air cylinder and valve support members which slidably support the valve within the air cylinder which are formed from an ultra-high-molecular-weight polyethylene having good electrical insulating properties;

(2) a thin elongated electrode for charging paint particles which is inserted into the center hole of the valve so that the rear end of the electrode extends rearward from the rear end of the valve;

(3) a nozzle-needle valve assembly which is integrally formed by attaching and fixing a paint nozzle to a cylindrical front extension formed by forwardly extending the front end portion of the air cylinder of the needle valve device, and is attached and fixed to the gun body by inserting and fitting it into a generally cylindrical cavity in the gun body from the front side thereof, said cylindrical cavity being formed in a front end portion of the gun body to have an opening facing forward;

(4) an integral molded body which is formed by molding a synthetic resin having good insulating properties to embed a transformer having a low-voltage primary winding and a high-voltage secondary winding, a rectifier type direct current high-voltage generator connected to the secondary output terminals of the transformer, and a spiral-wound flat, high-resistance element whose one end is connected to the output terminal of the direct current high-voltage generator therein, and is attached and fixed to the gun body by inserting and fitting it from the rear side of the gun into a cavity formed in a rear portion of the gun body to have an opening facing rearward; and (5) a low-voltage cable which is introduced into a rear end portion of the gun body and is connected to the primary input terminals of the transformer embedded in said integral molded body, and the other end of the high-resistance element embedded in said integral molded body being connected to the rear end of the paint particle charging electrode by a spring connection element attached to a rear end wall of the air cylinder of said needle valve device.

In the air atomizing electrostatic coating gun in accordance with the present invention having the aforementioned construction, a ceramic material which forms the valve of the needle valve device has a hardness and a wear resistance remarkably higher than those of a synthetic resin generally used as a material for forming a paint nozzle. Therefore there is no possibility of the valve wearing during the use of the gun, and, hence, no reduction in the sealing function of the valve. Consequently, the useful life of the needle valve device is greatly increased. Since the rod valve and the piston of the needle valve device are made of ceramic materials while the air cylinder and each of the valve support members are made of ultra-high-molecular-weight polyethylene materials having high insulating properties, and since the charging electrode having a comparatively short length which is inserted into- the center hole of the ceramic valve and is connected at its rear end to a high-resistance element, has a small electric capacitance, it is possible to completely prevent the risk of occurrence of spark discharge and assure a high level of safety. The paint nozzle is attached and fixed to the front cylindrical extension of the air cylinder of the needle valve device to form an integral nozzle-needle assembly. It is, therefore, possible to reduce the length of the charging electrode and minimize the capacitance thereof. Since the nozzle-needle valve assembly is detachably attached to the gun body by inserting and fitting it from the front side of the gun body into the cavity having a forwardly facing opening formed at the front end portion of the gun body, the nozzle-needle valve assembly can be readily checked, repaired and replaced as desired without any complicated work by drawing it out from the cavity, and thus the maintenance of the gun is facilitated. Since the integral molded body is formed into an adequately small size by molding a synthetic resin material to embed the transformer, the direct current high-voltage generator and the spiral-wound, flat, high-resistance resistor having a small volume, is mounted inside of the gun body by inserting and fitting it from the rear side of the gun into the cavity having a rearwardly facing opening formed in a rear end portion of the gun body, and since a low-voltage alternating current is supplied to the primary input terminals of the transformer by the low-voltage cable introduced into the rear end portion of the gun body to apply a dc high voltage generated by the direct current high-voltage generator to the charging electrode through the high-resistance element, the weight and the size of the gun body are not greatly increased by accommodating the integral molded body incorporating the direct current high-voltage generator in the rear end portion of the gun body. The coating gun may, therefore, be adapted for automatic operation under the control of a robot system because a light, low-voltage cable having considerably high flexibility is used instead of a conventional type high-tension cable to supply electric power to the spray gun. Moreover, if the transformer or the direct current high voltage generator gets out of order, the integral molded body can be removed from the gun body and replaced with a new one, thus enabling the spray gun to be easily repaired in a simple manner, and remarkably facilitating the maintenance of the spray gun:

Other specific constructions and advantages of the air atomizing electrostatic coating gun of the present invention will become clear upon reading the following description in connection with the accompanying drawings.

DETAILED DESCRIPTION OF THE PREFERRED EMBODIMENTS

Figure 1:
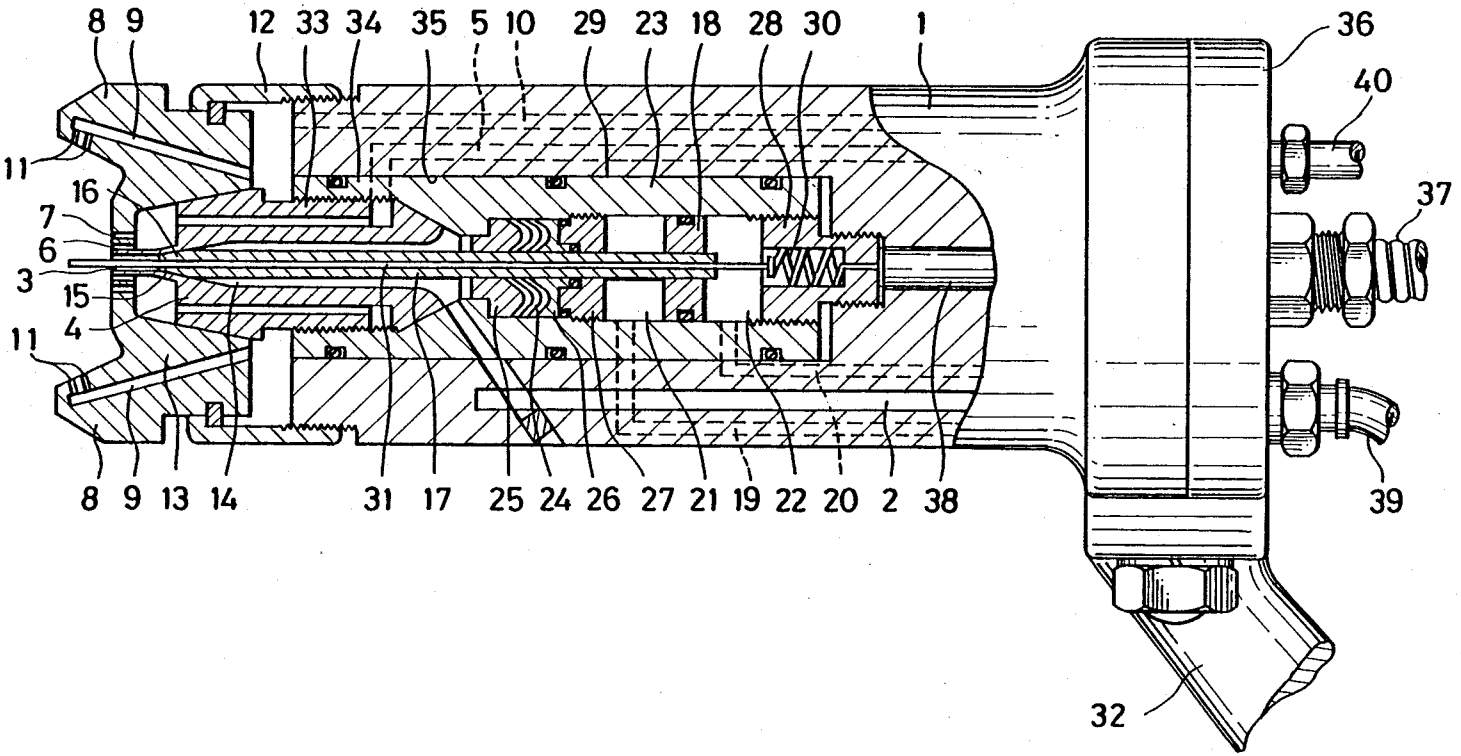
FIG. 1 is a schematic side view partly in section of an air atomizing electrostatic coating gun which represents one embodiment of the present invention in which an essential part is shown in section.

An air atomizing electrostatic coating gun which represents an embodiment of the present invention will be described below with reference to FIG. 1. This coating gun comprising, a gun body 1 made of a suitable insulating material such as a synthetic resin having a diameter of about 50 mm and a length of about 160 mm; a paint nozzle 4 made of a suitable synthetic resin insulating material, which is disposed at the front end of the gun body 1 to eject from a front end opening 3 a liquid paint supplied through a paint supply passage 2 drilled through a wall portion of the gun body; and a paint atomizing air cap 13 made of a suitable synthetic resin, which has a diameter of about 50 mm and is attached and fixed to the front end of the gun body 1 by means of an attachment nut 12. The air cap 13 has a central atomizing air orifice 6 and a plurality of atomizing air orifices 7 surrounding said central orifice which communicate with an atomizing air supply passage 5 drilled through a wall portion of the gun body, and shaping air orifices 11 opened respectively on the inner side surfaces of the front ends of a pair of hornlike projections 8 symmetrically extending forward from opposite sides of the atomizing air orifices. The shaping air orifices 11 communicate with a shaping air supply passage 10 drilled through a wall portion of the gun body through air passages 9 formed in the projections 8, and eject air for shaping a spray pattern of paint particles which are ejected from the paint nozzle 4 and atomized by air jets from the central atomizing air orifice 6 and the atomizing air orifices 7. The coating gun also comprising, a needle valve device 29 which is constituted of a rod valve 17 formed of an elongated ceramic pipe of about 5 mm diameter and about 70 mm length and having a thin axial center hole, the front end portion 16 of the rod valve 17 is generally in the shape of a cone and is brought into contact with or detached from a valve seat 15 formed by a tapered inner wall of a front portion of a paint chamber 14 formed in the paint nozzle 4; a valve driving piston 18 made of a ceramic material that readily bonds with the valve 17 and is fixed to the rear end of the valve 17; an air cylinder portion 23 in the form of a circular tube having an outside diameter of about 22 mm and an inside diameter of about 14 mm formed of an ultra-high-molecular-weight polyethylene having good electrical insulating properties, which accommodates the piston 18, and is adapted to retract and advance the valve 17 and the piston 18 through a stroke of about 5 mm in accordance with the air supply to a front cylinder chamber 21 and a rear cylinder chamber 22 through air passages 19 and 20 drilled in wall portions of the gun body; valve support members 25, 26 and 27 made of an ultra-high-molecular-weight polyethylene, disposed in the air cylinder 23 and function as slide bearings for the rod valve and as retaining members for V-shaped packing 24 which provides sealing between the valve and the air cylinder; and a rear cylinder cap 28 attached to the rear end of the air cylinder 23 to close a rear end of the opening of the air cylinder. Other components of the coating gun are, a paint particle charging electrode 31 made of a thin elongated metal body having a diameter of about 0.5 mm and a length of about 85 mm, inserted into and fixed to the center hole of the rod valve rod 17, which has a front end that passes through the front end opening 3 of the paint nozzle 4 and projects forward therefrom by about 5 mm (when paint is ejected) and a rear end connected to a helical spring connector element 30 disposed in a cylindrical hole formed in the rear cylinder cap 28 which closes the rear end opening of the air cylinder 23; and a change-over valve means (not shown) disposed at a suitable position outside the gun body 1, such as on an operating arm of a spray gun robot system (not shown), to which the support arm 32 of the gun extending at an angle rearward and downward from the rear end of the gun body 1 is to be connected. The change-over valve means has an ordinary construction suitable for controlling the change-over of supply of air to the front and rear cylinder chambers 21 and 22 of the air cylinder 23 through the air passages 19 and 20 formed within the wall portions of the gun body 1. A rear end portion 33 of the paint nozzle 4 having an outside diameter of about 15 mm is fitted into and fixed to the hollow portion of a cylindrical extension 34 formed by cylindrically extending the front end portion of the air cylinder 23 of the needle valve device 29, thereby integrally forming a nozzle-needle valve assembly. This nozzle-needle valve assembly is detachably attached and fixed to the gun body 1 by inserting and fitting it into a generally cylindrical cavity 35 of about 22.5 mm diameter, formed in the front end portion of the gun body 1, through a front opening of the cavity facing frontward. On the other hand, the rear end of the spring connector element 30 disposed in the cylindrical hole of the rear cylinder cap 28 of the air cylinder 23 is the needle valve device 29, is led through the rear wall of the cap 28 and connected to the front end of a rodlike resistor 38 having a high resistance value of, for instance, about 100 MΩ and is disposed in a cylindrical hole formed in rear end portion of the gun body 1, and the rear end of the resistor 38 is connected to a central conducting wire of a high-tension cable 37 introduced into the gun body 1 through a rear wall 36 attached to the rear end of the gun body 1. A dc high voltage of 50 kV to 70 kV is applied to the charging electrode 31 from a suitable direct current high-voltage generator placed at a suitable position separate from the coating gun through the high-tension cable 37 and the rodlike resistor 38, thereby supplying negative charge on paint particles ejected from the front end opening 3 of the paint nozzle 4 and atomized by the air jetted from the atomizing air orifices 6 and 7 formed in the air cap 13. Liquid paint is supplied at a rate of, for instance, about 300 to 1000 cc/min to the paint chamber 14 of the paint nozzle 4 through a paint supply hose 39 extending from a paint supply source separate from the coating gun and introduced into the gun body through the rear wall 36 of the gun body 1 and is connected to the rear end of the paint supply passage 2 drilled through the wall portion of the gun body. Atomizing air is supplied to the atomizing air orifices 6 and 7 of the air cap 13 by an atomizing air hose 40 extending from a suitable high-pressure air source that supplies air at a pressure of about 3.5 kg/cm$^2$, through a control valve and introduced through the rear wall 36 of the gun body 1 and is connected to the rear end of the atomizing air supply passage 5. Similarly, shaping air is supplied to the shaping air orifices 11 by a shaping air hose (not shown) which is connected through another control valve to the high-pressure air source, and introduced through the rear wall 36 and is connected to the rear end of the shaping air passage 10. The needle valve device 29 is controlled and operated in such a manner that a pair of air hoses (not shown) extending from the above-mentioned change-over valve means are introduced through the rear wall 36 and connected respectively to the rear ends of the air passages 19 and 20 so that high-pressure air of, for instance, about 3.5 kg/cm$^2$ is selectively supplied to the front cylinder chamber 21 or the rear cylinder chamber 22 of the air cylinder 23.

An air atomizing electrostatic coating gun which represents another embodiment of the present invention will be described below with reference to FIG. 2. This coating gun comprising, a gun body 1 made of a suitable insulating material such as a synthetic resin, having an overall length of about 230 mm and consists of a front-half portion in the form of a circular tube having a diameter of about 50 mm and a rear-half portion generally in the form of a rectangular tube having a width of about 70 mm and a height of about 50 mm; a paint nozzle 4 made of a suitable synthetic resin insulating material, which is disposed at the front end of the gun body 1 to eject from a front end opening 3 a liquid paint supplied through a paint supply passage 2 drilled through a wall portion of the gun body; and a paint atomizing air cap 13 made of a suitable synthetic resin, which has a diameter of about 50 mm and attached and fixed to the front end of the gun body 1 by means of an attachment nut 12. The air cap 13 has a central atomizing air orifice 6 and a plurality of atomizing air orifices 7 surrounding said central orifice which communicate with an atomizing air supply passage 5 drilled through a wall portion of the gun body, and shaping air orifices 11 opened respectively on the inner side surface of the front ends of a pair of hornlike projections 8 symmetrically extending forward from opposite sides of the atomizing air orifices. The shaping air orifices 11 communicate with a shaping air supply passage 10 drilled through a wall portion of the gun body through air passages 9 formed in the projections 8, and eject air for shaping a spray pattern of paint particles which are ejected from the paint nozzle 4 and atomized by air jets from the central atomizing air orifice 6 and the atomizing air orifices 7. The coating gun also comprising a needle valve device 29 which is constituted of, a rod valve 17 formed of an elongated ceramic pipe of about 5 mm diameter and about 70 mm length and having a thin axial center hole, the front end portion 16 of the rod valve 17 is generally in the shape of a cone and is brought into contact with or detached from a valve seat 15 formed by a tapered inner wall of a front portion of a paint chamber 14 formed in the paint nozzle 4; a valve driving piston 18 made of a ceramic material that readily bonds with the valve 17 and is fixed to the rear end of the valve 17; and an air cylinder portion 23 in the form of a circular tube having an outside diameter of about 22 mm and an inside diameter of about 14 mm formed of an ultra-high-molecular-weight polyethylene having good electrical insulating properties, which accommodates the piston 18, and is adapted to retract and advance the valve 17 and the piston 18 through a stroke of about 5 mm in accordance with air supplied to a front cylinder chamber 21 and a rear cylinder chamber 22 through air passages 19 and 20 drilled in wall portions of the gun body; valve support members 25, 26 and 27 made of an ultra-high-molecular-weight polyethylene disposed in the air cylinder 23 and function as slide bearings for the rod valve and as retaining members for V-shaped packing 24 which provides sealing between the valve and the air cylinder; and a rear cylinder cap 28 attached to the rear end of the air cylinder 23 to close a rear end opening of the air cylinder. Other components of the coating gun are, a paint particle charging electrode 31 made of a thin elongated metal body having a diameter of about 0.5 mm and a length of about 85 mm, which is inserted into and fixed to the center hole of the rod valve 17, which has a front end that passes through the front end opening 3 of the paint nozzle 4 and projects forward therefrom by about 5 mm (when paint is ejected) and which has a rear end connected to a helical spring connector element 30 disposed in a cylindrical hole formed in the rear cylinder cap 28 which closes the rear end opening of the air cylinder 23; a change-over valve means having a suitable ordinary construction (not shown) disposed at a suitable position outside the gun body 1, such as on an operating arm of a spray gun operating robot system (not shown) to which the support arm 32 of the gun extending at an angle rearward and downward from the rear end of the gun body 1 is to be connected, for controlling the change-over of supply of air to the front and rear cylinder chambers 21 and 22 of the air cylinder 23 through the air passages 19 and 20 formed within the wall portions of the gun body 1; and a box-like integral molded body 49 having a width of about 40 mm, a height of about 30 mm and a length of about 85 mm, which is formed by molding a suitable synthetic resin material that has good insulating characteristics to embed a high-voltage power source therein. This high-voltage power source is constituted of a boosting transformer 43 having a diameter of about 20 mm and an axial length of about 300 mm and consisting of, for instance, a low-voltage primary winding 41 of 100 V and a high-voltage secondary winding 42 of 50 kV; a direct current high-voltage generator 44 having a width of about 30 mm, a height of about 20 mm and a length of about 40 mm, and consisting of a Cockcroft network whose input terminals are connected to a pair of terminals of the secondary winding 42 of the transformer 43; and a spiral-wound flat high-resistance resistor 45 having a width of about 1 mm, a height of about 15 mm and a length of about 30 mm and having a resistance of 100 MΩ, one of a pair of terminals of the resistor 45 being connected to an output terminal of the direct current high-voltage generator 44. A flat contact element 46, connected to the other terminal of the high-resistance resistor 45, is attached to the front end surface of the molded body 49, and a pair of buttonlike contact elements 47 and 48, which are connected to the terminals of the primary winding 41 of the transformer 43, are attached to the rear end surface of the molded body 49. A rear end portion 33 of the paint nozzle 4, having an outside diameter of about 15 mm, is fitted into and fixed to the hollow portion of a cylindrical extension 34 which is formed at the front end portion of the air cylinder 23 of the needle valve device 29, thereby integrally forming a nozzle-needle valve assembly. This nozzle-needle valve assembly is detachably attached and fixed to the gun body 1 by inserting and fitting it into a generally cylindrical cavity 35 of a diameter of about 22.5 mm which is formed in the front portion of the gun body 1, through a frontwardly facing front opening of the cavity. Similarly, the integral molded body 49 which incorporates the high-voltage power source is detachably attached and fixed to the gun body 1 by inserting and fitting it into a cavity 50 in the gun body 1 through a rearwardly facing opening thereof. The cavity 50 is formed in the rear-half portion of the gun body 1 in the form of a generally rectangular tube to have rectangular cross-section of about 40.5 mm width and about 30.5 mm height. The rear end of the spring connector element 30 disposed in the cylindrical hole of the rear cylinder cap 28 of the air cylinder 23 in the needle valve device 29, is led through the rear wall of the cap and is connected to the flat contact element 46 provided on the front end surface of the integral molded body 49 incorporating the high-voltage power source, and a pair of cable conductors of a low-voltage cable 51 introduced into the gun body 1 through the rear wall 36 of the gun body are connected respectively to the pair of buttonlike contact elements 47 and 48 disposed on the rear end surface of the integral molded body 49. An alternating current of 50 Hz or 60 Hz is supplied from a suitable 100-V alternating current power source, such as the power lines, to the primary winding of the transformer 43 by the low-voltage cable 51, and a dc high voltage of 50 kV generated by the direct current high-voltage generator 44 is applied to the charging electrode 31 through the high-resistance resistor 45. Liquid paint is supplied at a rate of, for instance, about 300 to 1000 cc/min to the paint chamber 14 of the paint nozzle 4 through a paint supply hose 39 which extends from a paint supply source separate from the spray gun and is introduced into the gun body 1 through the rear wall 36 of the gun body is connected to the rear end of the paint supply passage 2. Atomizing air is supplied to the atomizing air orifices 6 and 7 of the air cap 13 by an atomizing air hose 40 which is connected through a control valve (not shown) to a suitable high-pressure air source that supplies air at a pressure of about 3.5 kg/cm$^2$, and introduced through the rear wall 36 of the gun body 1 and is connected to the rear end of the atomizing air supply passage 5. Similarly, shaping air is supplied to, the shaping air orifices 11 by a shaping air hose (not shown) which is connected through another control valve to the high-pressure air source and introduced through the rear wall 36 and is connected to the rear end of the shaping air passage 10. The operation of the needle valve device 29 that controls the operation of ejecting paint from the paint nozzle is controlled in such a manner that a pair of air hoses (not shown), extending from the change-over valve means disposed on the operating arm of the coating gun robot system (not shown), to which the support arm 32 extending at an angle rearward and downward from the rear end of the gun body 1 is attached and fixed, are introduced through the rear wall 46 of the main body 1 and are connected respectively to the rear ends of the air passages 19 and 20 so that high-pressure air of, for instance, about 3.5 kg/cm$^2$ is selectively supplied to the front cylinder chamber 21 or the rear cylinder chamber 22 of the air cylinder 23.

This air atomizing electrostatic coating gun is suitable for use in an automatic painting process in which the support arm 32 of the gun body 1 is attached to an operating arm of a spray coating gun robot system and in which an automatic control device incorporated in the robot system to control the supply of power through the low-voltage cable, the operation of the control valves which control the atomizing air and shaping air, and the change-over valve means for the needle valve device, as well as the operation of moving the coating gun or changing the direction of the gun.

An air atomizing electrostatic coating gun which represents still another embodiment of the present invention will be described below with reference to FIG. 3. This coating gun comprising, a gun body 1 made of a suitable insulating material such as a synthetic resin having a diameter of about 60 mm and a length of about 165 mm; a paint nozzle 4 made of a synthetic resin insulating material of the type widely used as a material for forming a paint nozzle such as one marketed under the commercial name of "Delrin", is disposed at the front end of the gun body 1 to eject from a front end opening 3 a liquid paint supplied through a paint supply passage 2 drilled through a wall portion of the gun body; and a paint atomizing air cap 13 made of a suitable synthetic resin, which is mounted on and fixed to the front end of the gun body 1 by means of an attachment nut 12. The air cap 13 has a central atomizing air orifice 6 and a plurality of atomizing air orifices 7 surrounding the central orifice which communicate with an atomizing air supply passage 5 drilled through a wall portion of the gun body, and shaping air orifices 11 opened respectively on the inner side surface of the front ends of a pair of hornlike projections 8 symmetrically extending forward from the opposite sides of the atomizing air orifices. The shaping air orifices 11 communicate with a shaping air supply passage 10 drilled through a wall portion of the gun body through air passages 9 formed in the projections 8, and eject air for shaping a spray pattern of paint particles which are ejected from the paint nozzle 4 and atomized by air jets from the central atomizing air orifice 6 and the atomizng air orifices 7. The coating gun also comprises, a paint particle charging electrode 31 made of a thin elongated metal body which has a diameter of about 0.5 mm and a length of about 55 mm, which is inserted into a center hole of an electrode supporting element 15 and is fixed to this element. The electrode supporting element 15 is formed of a ceramic pipe having a diameter of about 6 mm and a length of about 35 mm which has an axial center hole and a plurality of wart-like projections each having a height of about 1.5 mm on the peripheral side wall. The electrode supporting element 15 is inserted, fitted into and fixed in a cylindrical paint chamber 14 formed in the paint nozzle 4. The front end of the charging electrode 31 passes through the front end opening 3 of the paint nozzle 4 and projects forward from the front end opening 3 by about 5 mm. The coating gun further comprises, a boxlike integral molded body 49 having a width of about 40 mm, a height of about 30 mm and a length of about 85 mm, which is formed by molding a suitable synthetic resin material having good insulating properties, to embed a high-voltage power source therein. This high-voltage power source is constituted of a boosting transformer 43 having a diameter of about 20 mm and an axial length of about 300 mm and consisting of, for instance, a low-voltage primary winding 41 of 100 V and a high-voltage secondary winding 42 of 50 kV; a direct current high-voltage generator 44 having a width of about 30 mm, a height of about 20 mm and a length of about 40 mm, and consisting of a Cockcroft network whose input terminals are connected to a pair of terminals of the secondary winding 42 of the transformer 43; and a spiral-wound flat high-resistance spiral resistor 45 having a width of about 1 mm, a height of about 15 mm and a length of about 30 mm, and having a resistance of 100 MΩ; one of a pair of terminals of the resistor 45 being connected to an output terminal of the direct current high-voltage generator 44. A flat contact element 46, connected to the other terminal of the high-resistance resistor 45, is attached to the front end surface of the molded body 49, and a pair of buttonlike contact elements 47 and 48, which are connected to the terminals of the primary winding 41 of the transformer 43, are attached to the rear end surface of the molded body 49. The integral molded body 49 which incorporates the high-voltage power source is detachably attached and fixed to the gun body 1 by inserting and fitting it into a cavity 50 of a width of about 40 mm and a height of about 30 mm formed in the gun body 1, through a rear opening which is formed in a rear end portion of the gun body 1 and faces rearward. The rear end of the paint particle charging electrode 31, which is inserted into and fixed in the center hole of the electrode supporting element 15, is connected by a suitable spring connector element 30 to the flat contact element 46 disposed on the front end surface of the integral molded body 49 incorporating the high-voltage power source, and a pair of cable conductors of a low-voltage cable 51 introduced into the gun body 1 through the rear wall 36 of the gun body are respectively connected to the pair of buttonlike contact elements 47 and 48 disposed on the rear end surface of the integral molded body 49. An alternating current of 50 Hz or 60 Hz is supplied from a suitable 100-V alternating current power source, such as the power lines, to the primary winding of the transformer 43 by the low-voltage cable 51, and a dc high voltage of 50 kV, generated by the direct current high-voltage generator 44, is applied to the charging electrode 31 through the high-resistance resistor 45. Liquid paint is supplied at a rate of, for instance, about 300 to 1000 cc/min to the paint chamber 14 of the paint nozzle through a paint supply hose 39 which extends from a paint supply source separate from the spray gun and introduced into the gun body through the rear wall 36 of the gun body connected to the rear end of the paint supply passage 2. Atomizing air is supplied to the atomizing air orifices 6 and 7 of the air cap 13 by an atomizing air hose 40 which is connected through a control valve (not shown) to a suitable high-pressure air source that supplies air at about 3.5 kg/cm$^2$, and introduced through the rear wall 36 of the gun body 1 and is connected to the rear end of the atomizing air supply passage 5. Similarly, shaping air is supplied to the shaping air orifices 11 by a shaping air hose (not shown) which is connected through another control valve to the high-pressure air source, and introduced through the rear wall 36 and is connected to the rear end of the shaping air passage 10.

This air atomizing electrostatic coating gun is suitable for use in an automatic painting process in which the supporting arm 32 of the gun body 1 is attached to the operating arm of a coating gun operating robot system (not shown), and the operation of the gun is controlled and operated by an automatic control device incorporated in the robot system.

Figure 2:
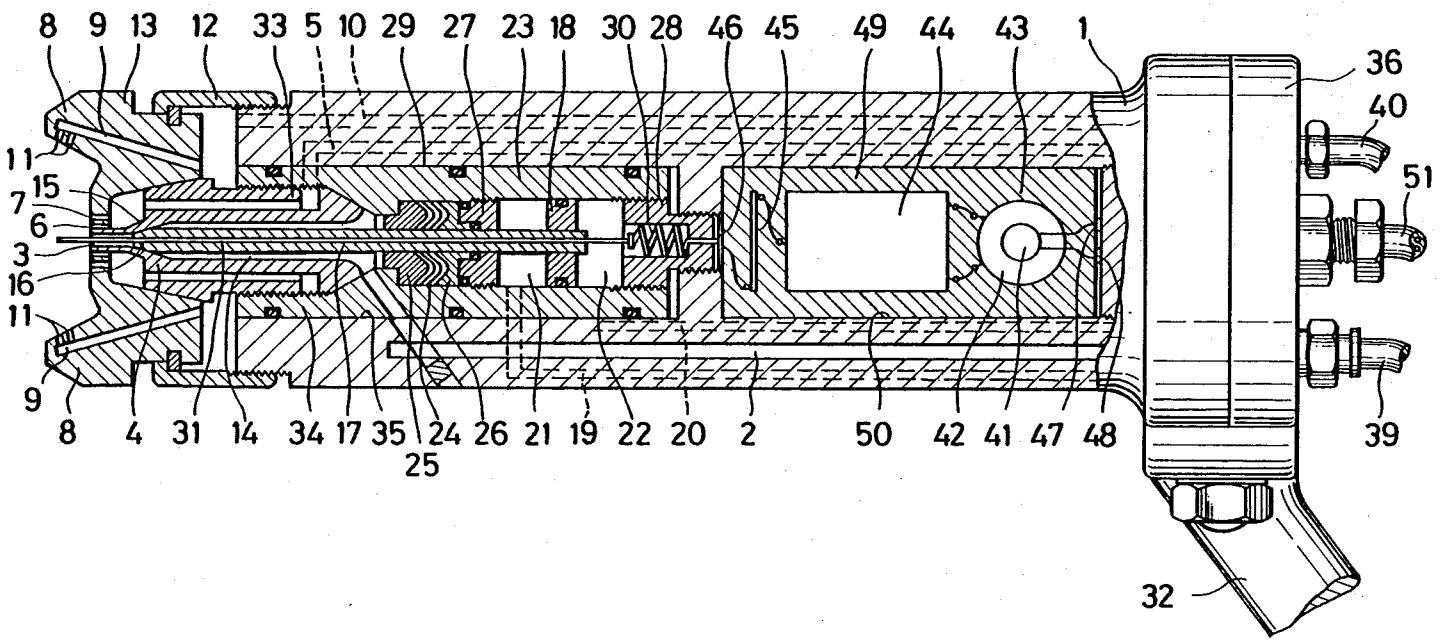
FIG. 2 is a schematic side view partly in section of an air atomizing electrostatic coating gun which represents another embodiment of the present invention.
Figure 3:
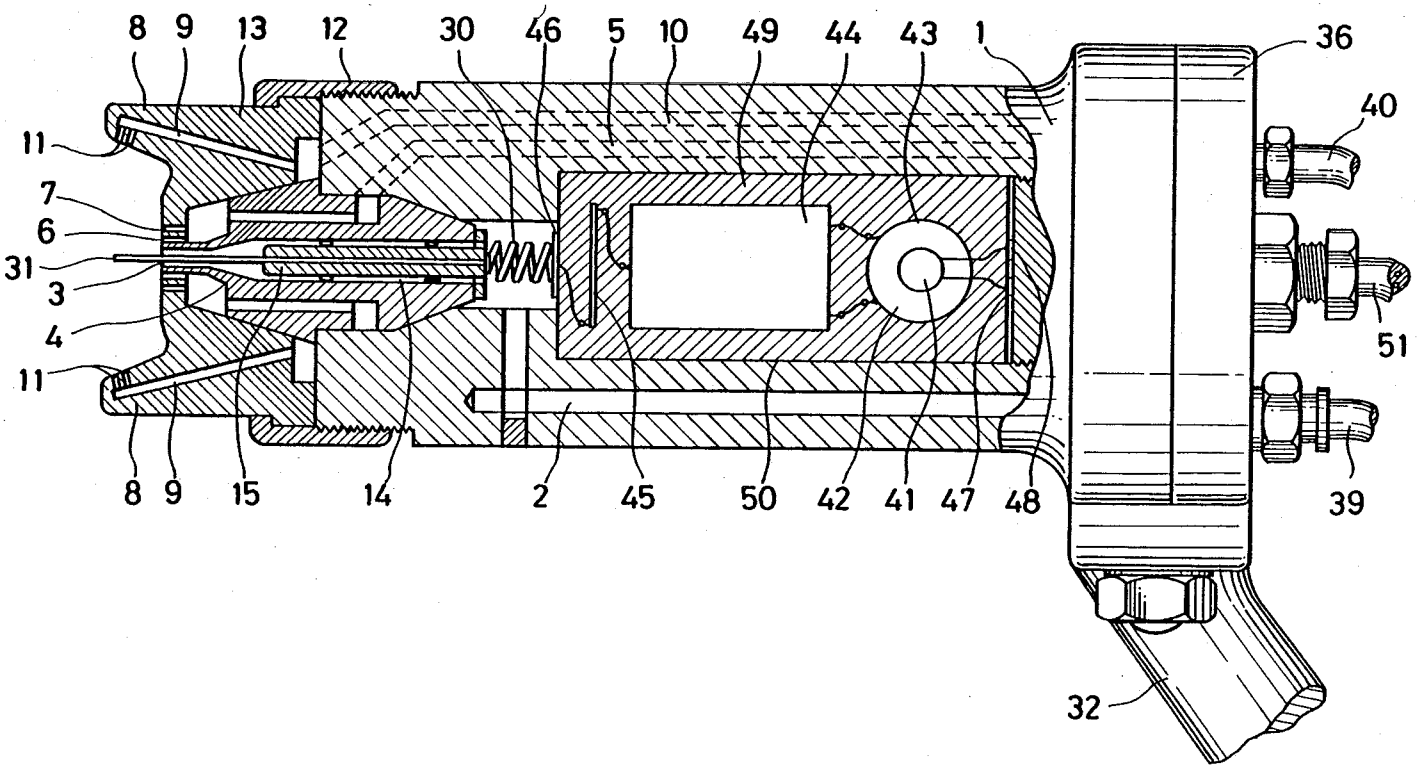
FIG. 3 is a schematic side view partly in section of an air atomizing electrostatic coating gun which represents still another embodiment of the present invention.

The air atomizing electrostatic coating guns in accordance with the present invention which have constructions shown in FIGS. 1 to 3 are free from the above-described defects and problems of the conventional coating gun of this type and have practical and remarkable advantages, as described below.

(1) Since the rod valve in the needle valve device is formed of a ceramic pipe which has remarkably improved hardness and wear resistance compared with synthetic resins generally used as a material for forming a paint nozzle, there is no possibility of the valve wearing during the usage of the gun, and, hence, no reduction in the sealing property of the valve, thereby greatly increasing the useful life of the needle valve device.

(2) The rod valve and the piston of the needle valve device are formed of ceramic materials, and the air cylinder and each of the valve support members are formed of ultra-high-molecular-weight polyethylene materials having good insulating properties. The charging electrode inserted into the center hole of the valve is comparatively thin and short and, thereby, has a sufficiently small electric capacitance. It is, therefore, possible to completely prevent the risk of occurrence of spark discharge and thereby a high level of safety can be ensured.

(3) The nozzle-needle valve assembly is formed by mounting and fixing the paint nozzle to the cylindrical extension formed at the front end of the air cylinder of the needle valve device. It is, therefore, possible to reduce the length of the rod valve and ensure a close engagement between the slanted inner wall of the nozzle which acts as a valve seat and the front end of the valve body which acts as a valve, thereby enabling the needle valve device to operate more accurately. In addition, the charging electrode is necessarily shortened when the length of the rod valve is reduced. This also brings a reduction of the electric capacitance of the charging electrode.

(4) Since the integral nozzle-needle valve assembly is detachably attached to the gun body by inserting and fitting it into the cavity having a forwardly facing opening formed in the front end of the gun body, the needle valve device can be checked, repaired or replaced as desired without any complicated work by dismounting it from the nozzle-needle valve assembly. The maintenance of the spray gun is thus facilitated.

(5) The boosting transformer, the direct current high-voltage generator and the small-sized, spiral-wound flat high-resistance resistor are embedded in a mold of synthetic resin having good insulating properties and formed into an integral molded body. The integral molded body is detachably attached to and fixed within the gun body by inserting and fitting it into the cavity having a rearwardly facing opening formed at the rear end of the gun body, and a low alternating current voltage is supplied from an ordinary low-voltage power source to the transformer by an elastic and flexible low voltage cable, thereby applying a high dc voltage to the charging electrode. Therefore, the electrical insulation between the power supply system and the gun body is remarkably simplified. Also, the smooth operation of the coating gun is not hindered by a heavy and bulky power supply cable for the spray gun, so that it is possible to operate the spray gun very easily and smoothly with only a small operating force.

(6) The integral molded body incorporating the high-voltage power source is detachably attached to the gun body by inserting and fitting it into the cavity in the gun body. Therefore, if the transformer or the direct current high voltage generator is out of order, the integral molded body can be removed from the gun body and replaced with a new one, thus enabling the spray gun to be easily repaired in a simple manner without any complicated work, thereby facilitating the maintenance of the spray gun.

What is claimed is:

1. An air atomizing electrostatic coating gun comprising, a gun body including a front end and a rear end;

a paint nozzle disposed at the front end of the gun body to eject a liquid paint supplied through a paint supply passage formed through a wall portion of said gun body;

an air cap for atomizing liquid paint ejected from said paint nozzle, and said air cap being disposed at the front end of said gun body and having a central air orifice through which said nozzle extends and a plurality of air orifices encircling said central air orifice, said central air orifice and said plurality of air orifices communicating with an atomizing air supply passage formed through a wall portion of said gun body;

a needle valve device for controlling ejection of said paint from said paint nozzle, said needle valve device being disposed inside said gun body and having a thin, elongated, rodlike valve having a front end portion generally in the shape of a cone adapted to be selectively brought into contact with or detached from a valve seat formed by a slanted inner wall of said paint nozzle, a valve driving piston fixed to a rear end of said valve, and an air cylinder accomodating said piston therein;

a paint-particle charging electrode made of an elongated conductor attached to said valve of said needle valve device, the front end of said charging electrode projecting forward from a front end opening of said paint nozzle, and a dc high voltage source coupled to said charging electrode through a high-resistance element; and means for controlling said needle valve device to selectively place the front end portion of said rodlike valve into contact with or detacted from said valve seat with exposure of said valve driving piston to pressure generated by supplying air to said air cylinder through an air passage formed through a wall portion of said gun body;

said air cylinder of said needle valve device having a forwardly extending, cylindrical frontend portion to which said paint nozzle is attached so as to form a nozzle-needle valve assembly, said nozzle-needle valve assembly being detachably attached and fixed to said gun body by inserting and fitting it into a generally cylindrical cavity in said gun body from the front side thereof, said cylindrical cavity being formed at the front end of said gun body to have a forwardly facing opening.

2. An air atomizing electrostatic coating gun according to claim 1, wherein valve support members which slidably support said valve in said air cylinder and all of said rodlike valve, said piston, and said air cylinder are made of insulating materials having good electrical insulating properties.

3. An air atomizing electrostatic coating gun according to claim 2, wherein a synthetic resin having good insulating properties is molded into an integral molded body to embed therein a transformer having a low-voltage primary winding and a high-voltage secondary winding, a rectifier type direct current high-voltage generator connected to secondary output terminals of said transformer and a spiral-wound flat high-resistance element whose one end is connected to the output terminal of said direct current high-voltage generator, said integral molded body is attached and fixed in said gun body by inserting and fitting it into a cavity in said gun body from the rear end thereof, said cavity is formed in a rear portion of said gun body, to have a rearwardly facing opening, and a low-voltage cable introduced into a rear end portion of said gun body is connected to primary input terminals of said transformer, and the other end of said high-resistance element is connected to a rear end of said paint particle charging electrode by a spring connector element attached to a rear end wall of said air cylinder.

4. An air atomizing electrostatic coating gun according to claim 1, wherein said rodlike valve of said needle valve device is made of an elongated ceramic pipe having an axial center hole into which an elongated paint particle charging electrode is inserted.

5. An air atomizing electrostatic coating gun according to claim 4, wherein a synthetic resin having good insulating properties is molded into an integral molded body to embed therein a transformer having a low-voltage primary winding and a high-voltage secondary winding, a rectifier type direct current high-voltage generator connected to secondary output terminals of said transformer and a spiral-wound flat high-resistance element whose one end is connected to the output terminal of said direct current high-voltage generator, said integral molded body is attached and fixed in said gun body by inserting and fitting it into a cavity in said gun body from the rear end thereof, said cavity is formed in a rear portion of said gun body, to have a rearwardly facing opening, and a low-voltage cable introduced into a rear end portion of said gun body is connected to primary input terminals of said transformer, and the other end of said high-resistance element is connected to a rear end of said paint particle charging electrode by a spring connector element attached to a rear end wall of said air cylinder.

6. An air atomizing electrostatic coating gun according to claim 1, wherein a synthetic resin having good insulating properties is molded into an integral molded body to embed therein a transformer having a low-voltage primary winding and a high-voltage secondary winding, a rectifier type direct current high-voltage generator connected to a secondary output terminals of said transformer and a spiral-wound flat high-resistance element whose one end is connected to the output terminal of said direct current high voltage generator, said integral molded body is attached and fixed in said gun body by inserting and fitting it into a cavity in said gun body from the rear side thereof, said cavity is formed in a rear portion of said gun body, to have a rearwardly facing opening, and a low-voltage cable introduced into a rear end portion of said gun body is connected to a primary input terminals of said transformer, and the other end of said high-resistance element is connected to the rear end of said paint particle charging electrode by a spring connector element attached to a rear end wall of said air cylinder.

7. An air atomizing electrostatic coating gun comprising, a gun body including a front end and a rear end;

a paint nozzle disposed at the front end of the gun body to eject a liquid paint supplied through a paint supply passage formed through a wall portion of said gun body;

an air cap for atomizing liquid paint ejected from said paint nozzle, said air cap being disposed at the front end of said gun body and having a central air orifice through which said nozzle is passing and a plurality of air orifices encircling said central air orifice, said central air orifice and said plurality of air orifices communicating with an atomizing air supply passage formed through a wall portion of said gun body; and a paint-particle charging electrode mounted and supported inside said paint nozzle, a front end of said charging electrode is passing through said paint nozzle and projecting forward from a front opening of the nozzle, a dc high voltage being applied to said charging electrode through a high-resistance element;

wherein a synthetic resin having good insulating properties is molded into an integral molded body to embed therein a transformer having a low-voltage primary winding and a high-voltage secondary winding, a rectifier type direct current high-voltage generator connected to secondary output terminals of said transformer, and a spiral-wound, flat, high-resistance element whose one end is connected to an output terminal of said direct current high-voltage generator, said integral molded body is attached and a fixed in said gun body by inserting and fitting it into a cavity in said gun body from the rear end thereof, said cavity is formed in a rear portion of said gun body to have a rearwardly facing opening, and wherein a low-voltage cable introduced into a rear end portion of said gun body is connected to primary input terminals of said transformer, and the other end of said high-resistance element is connected to a rear end of said paint-particle charging electrode by a spring connector element.

* * * * *

UNITED STATES PATENT AND TRADEMARK OFFICE

CERTIFICATE OF CORRECTION

PATENT NO. : 4,824,026

DATED : April 25, 1989

INVENTOR(S) : TAMURA et al

It is certified that error appears in the above-identified patent and that said Letters Patent is hereby corrected as shown below:

In the title page of the patent:

Under "Foreign Application Priority Data", replace the fourth Japanese application "61-120730" with --61-120730[U]--.

The Assignees and their address should read as follows:

--Toyota Jidosha Kabushiki Kaisha
Ransburg-Gema KK--.

Signed and Sealed this

Twenty-first Day of August, 1990

*Attest:*

HARRY F. MANBECK, JR.

*Attesting Officer*

*Commissioner of Patents and Trademarks*